United States Patent [19]

McClain et al.

[11] 4,288,737

[45] Sep. 8, 1981

[54] REGULATOR-COMPENSATOR CONTROL

[75] Inventors: James E. McClain; Howard L. Scott, both of Greenville, Tex.

[73] Assignee: Esco Manufacturing Company, Dallas, Tex.

[21] Appl. No.: 40,857

[22] Filed: May 21, 1979

[51] Int. Cl.[3] ..... G05F 1/34

[52] U.S. Cl. ..... 323/254; 318/815

[58] Field of Search ..... 323/60–61, 323/82–83, 89 R, 89 M; 318/812–815; 307/102, 103, 105; 361/30–31, 33

[56] References Cited

U.S. PATENT DOCUMENTS

| | | | |
|---|---|---|---|
| 2,959,724 | 11/1960 | Dortort | 323/89 R |
| 3,075,138 | 1/1963 | Croft et al. | 323/60 |
| 3,710,233 | 1/1973 | Borkovitz | 323/56 X |
| 3,763,413 | 10/1973 | Wattenbarger | 318/814 X |
| 4,025,834 | 5/1977 | McClain et al. | 318/815 |

*Primary Examiner*—William M. Shoop
*Assistant Examiner*—Peter S. Wong
*Attorney, Agent, or Firm*—Kenneth R. Glaser

[57] ABSTRACT

Disclosed is a voltage regulation-unbalanced voltage compensation control connected intermediate the supply and load of the polyphase system, the control including separately adjustable variable impedance elements provided by saturable core reactors for independently varying the voltage drops between the supply and load terminals for each phase. The independent adjustment of the variable impedance elements is effected by a feedback control network varying the magnitude of current supplied to the DC control winding of each saturable core reactor in response to the existing load voltages across the load terminals.

5 Claims, 3 Drawing Figures

REGULATOR-COMPENSATOR CONTROL

The present invention relates to protection of polyphase equipment, more particularly to a method and apparatus for assuring balanced and regulated supply voltages for three phase loads, and even more particularly to an improved feedback control network for maintaining constant balanced voltages to induction motors.

Electrical rotating machinery, such as polyphase generators and motors, are desirably operated under symmetrical circuit conditions, i.e., balanced voltages and phase relationships. In reality, however, circuit conditions often exist which result in dissymmetries in these polyphase systems. For example, in the case of AC motors, such as the conventional three phase induction motor, line faults or source voltage fluctuations result in unbalanced voltages being supplied to the motor.

It has been early and firmly established that the result and effect of circuit dissymmetry or voltage imbalance between phases of a polyphase system is the generation of voltage and current components, referred to as negative sequence components, which have a phase sequence opposite to that of the line voltages. Unfortunately, these negative sequence components have a deleterious effect on the operation of the motor. For example, the negative sequence current which flows in the induction motor produces a magnetic field which revolves in a direction opposite the direction of rotation of the rotor, thus producing a reverse or counteracting torque. Additionally, and most significantly, the negative sequence currents result in excessive heating of the polyphase induction motor, it actually being determined that the negative sequence currents produce more heat per ampere than the heat resulting from positive sequence currents. Furthermore, the negative sequence components resulting from the unbalanced system cause vibration which not only increases noise, but is potentially injurious to the motor bearings, insulation, and interconnected mechanical equipment. Thus, the presence of negative sequence components not only reduces the operating efficiency of the motor, but results in equipment failure and consequent costly production delays.

As a consequence of the aforementioned difficulties, efforts have been directed to the design and development of protective networks and relays effective to sense the unbalanced conditions in order to interrupt the motor operation until correction of the conditions. Rather than interrupting the motor operation, however, it would be far better to have effective means for continuously compensating for the unbalanced voltage conditions to assure that voltages across the motor input terminals be maintained in balance.

It is therefore a principal object of the present invention to provide a new and improved method and apparatus for maintaining balanced voltage conditions at the input to a polyphase load.

It is another object of the present invention to provide a new and improved network for compensating for unbalanced (unequal in magnitude and phase) supply voltages so as to assure balanced voltages across the input terminals of polyphase equipment, particularly induction motors.

It is a still further object of the present invention to provide an improved feedback control system which not only effectively provides compensation for unbalanced conditions, but also provides true voltage regulation for the AC load.

In accordance with these and other objects, the present invention is directed to the provision of a compensation network intermediate the supply voltage and load input terminals, the compensation network including variable impedance elements which impedance is selectively controlled and varied to selectively alter the voltage drops, in each phase, between the supply and load terminals to assure balanced voltages to the load. In accordance with a specific feature of the invention, the variable impedance elements are saturable core reactors, the respective inductive reactance of which, is varied in response to unbalanced load voltages, thus providing effective and independent feedback control for each phase. The feedback control portion of the network is additionally effective to maintain constant voltage, i.e., voltage regulation, across the load terminals.

Specific additional features, objects, and advantages of the present invention will be more readily understood by reference to the following detailed description taken in conjunction with the accompanying drawings, wherein.

Figures 1, 3:
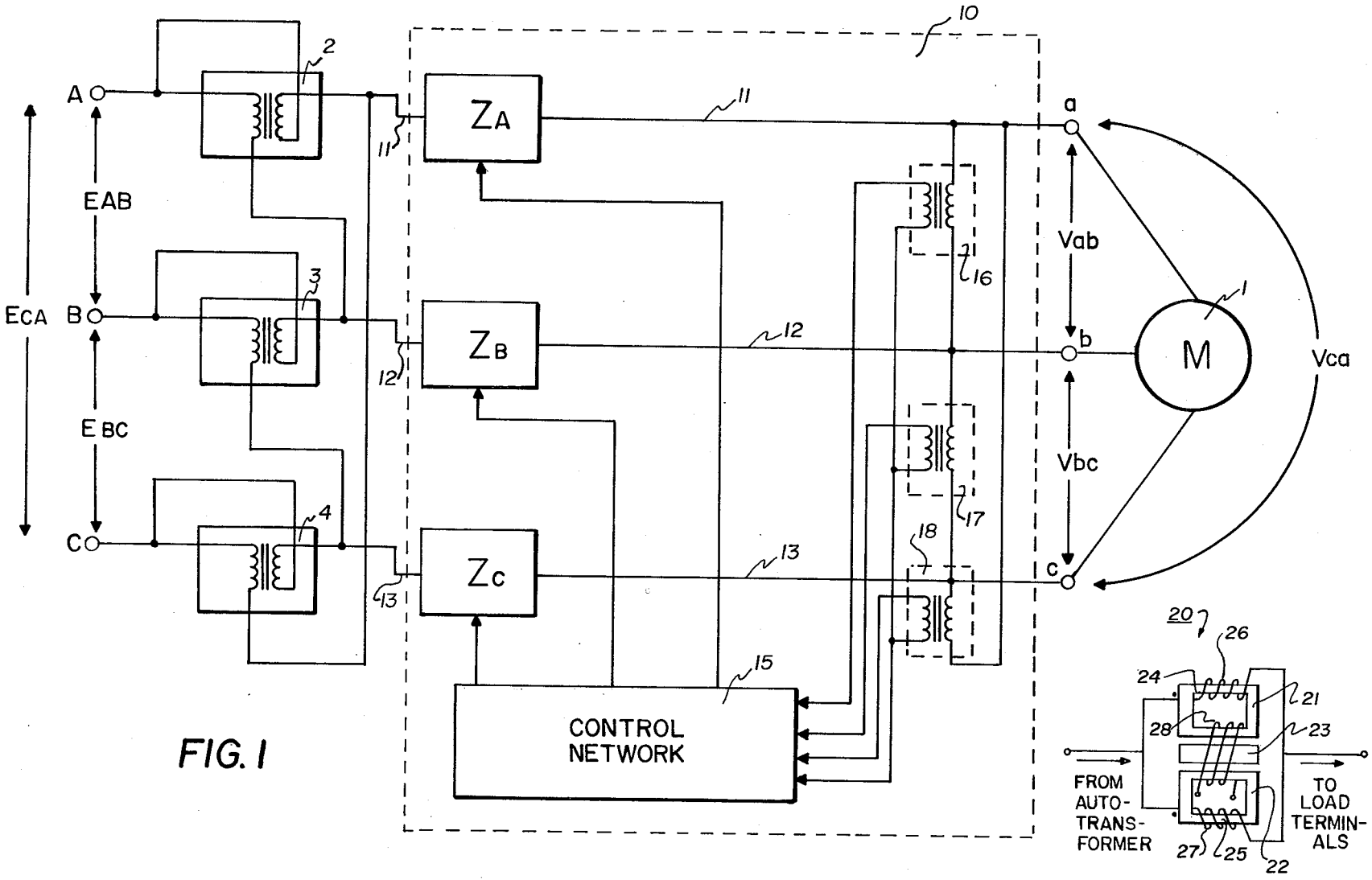
FIG. 1 is a schematic drawing, partially in block diagram form, illustrating the interconnection of the regulator-compensator control of the present invention.
FIG. 3 depicts, in diagrammatic form, a saturable core reactor of the type utilized for each of the variable impedance elements shown in FIG. 1.

Referring initially to FIG. 1, a conventional 3-phase induction motor 1 (with input terminals a, b, and c) is supplied power from the output of transformers 2, 3 and 4, the primaries of such transformers being coupled to a 3-phase electrical distribution system (not shown) by way of respective input terminals A, B, and C, all as conventionally known. While the transformers 2, 3 and 4 are illustrated in FIG. 1 as being interconnected autotransformers, other transformer configurations may be utilized to supply the requisite power from the input terminals A, B, and C to the input terminals a, b, and c of the induction motor 1.

Under idealized conditions, the supply voltages $E_{AB}$, $E_{BC}$, and $E_{CA}$ would be completely balanced (equal in magnitude and phase displaced from one another by 120°); and the input voltages $V_{ab}$, $V_{bc}$, and $V_{ca}$ to the induction motor would be similarly balanced. In actual operation, however, such balanced conditions do not normally exist due, for example, to fluctuations in the electrical distribution system, unequal impedances in the respective supply lines, transient voltage surges, etc. Thus, unless means are introduced for effectively compensating for such unbalanced conditions, the resulting unbalanced magnitude and phase of the voltages appearing across the input terminals a, b, and c of the load (induction motor 1) will result in the generation of the negative sequence currents previously discussed and the consequent harmful effects on the motor and its operation.

Consequently, and in accordance with the principles of the present invention, a network 10 is coupled between the outputs of transformers 2, 3, and 4 and the respective load (motor) input terminals a, b, and c for selectively controlling the voltage drop therebetween in order to assure balanced supply load voltages $V_{ab}$, $V_{bc}$, and $V_{ca}$. In addition, and as subsequently described in greater detail, the network 10 is also effective to maintain constant voltage, i.e. voltage regulation, at the terminals a, b, and c.

Specifically, the regulator-compensator network 10 comprises variable impedance elements $Z_A$, $Z_B$, and $Z_C$ respectively disposed in the supply lines 11, 12, and 13, the magnitude of the impedance presented by each of the elements $Z_A$, $Z_B$, and $Z_C$, and consequently the voltage levels at terminals a, b, and c, being regulated by a control network 15 responsive to fluctuations of load voltages $V_{ab}$, $V_{bc}$, and $V_{ca}$ respectively detected by voltage sensing transformers 16, 17, and 18.

As depicted in FIG. 1, the secondaries of voltage sensing transformers 16–18 are connected as inputs to the control network 15, the control network, the specific details and operation of which are subsequently described, being effective to compare the respective voltages sensed by the transformers 16–18 with a reference voltage (representing the desired magnitude of each of the voltages $V_{ab}$, $V_{bc}$, and $V_{ca}$) and generate, if required, separate error control signals to each of the impedance elements $Z_A$, $Z_B$, and $Z_C$ to selectively vary the AC impedance of such elements (and thus the respective voltage drops in supply lines 11–13) to the extent necessary to establish (or reestablish) balanced voltages to the motor 1. It is thus seen that the network 10 provides selective compensation in each phase for establishing the desired balanced conditions at the motor input. In addition, the network 10 is responsive to identical voltage fluctuations in all phases, the control network 15 being effective to compare such fluctuating voltages (sensed by transformers 16–18) with the reference voltage for generating an error signal simultaneously to all of the impedance elements $Z_A$, $Z_B$, and $Z_C$, the network 10 thereby under such circumstances, providing true voltage regulation.

In accordance with a specific feature of the present invention, each of the variable impedance elements $Z_A$, $Z_B$, and $Z_C$ is provided by a variable inductance device, specifically a saturable core reactor of the type depicted in FIG. 3 by the reference numeral 20. Specifically, the saturable core reactor comprises a pair of magnetic cores 21 and 22 separated by a spacer 23 of non-magnetic material. Respectively disposed around legs 24 and 25 of cores 21 and 22 are AC windings 26 and 27 wound in opposite directions around the core legs in the manner depicted in FIG. 3. These AC windings are electrically connected together in the manner shown in FIG. 3 with their inputs connected to the output of an auto-transformer (2, 3, or 4) and their outputs connected (by way of either supply lines 11, 12, or 13) to a load input terminal (a, b, or c).

A DC control winding 28 is disposed around the inner legs of the cores 21 and 22, the permeability of the magnetic cores being altered, in the manner well known in the art, by the magnitude of current flowing through the DC control winding 28. Thus, by increasing the current through the DC control winding, the cores are increasingly saturated, reducing the impedance (inductive reactance) of the AC windings and thereby reducing the voltage drop across the impedance element ($Z_A$, $Z_B$, or $Z_C$) itself. In similar manner, decreases in the current through the DC control winding 28 will increase the impedance, thereby increasing the voltage drop across the impedance element.

It is thus believed readily apparent that by providing a device 20 of the type just described for each of the variable impedance elements $Z_A$, $Z_B$, and $Z_C$ depicted in FIG. 1; and by regulating the amount of DC current that flows through the DC control winding 28 of each such device in response to departures of the respective voltages across the terminals a, b, and c from desired voltage magnitudes, desired voltage drops can be selectively introduced into the supply lines 11, 12, or 13 so as to maintain balanced voltages $V_{ab}$, $V_{bc}$, and $V_{ca}$ of the desired magnitude notwithstanding the existence, for example, of unbalanced supply voltages $E_{AB}$, $E_{BC}$, and $E_{CA}$. Furthermore, voltage regulation can be maintained by simultaneously increasing (or decreasing) the extent of DC current supplied to the control winding 26 of all three saturable core reactors in response to deviations (positive or negative) of the actual voltages at across the terminals a, b, and c from the desired voltage.

The magnitude of the DC current supplied to each of the D-C control windings 28 is determined and regulated by the control network 15, the specific details and operation of which are now described with reference to FIG. 2. Accordingly, and as previously mentioned, the outputs of the secondary windings of the voltage sensing transformers 16–18 are connected as inputs to the control network 15, and specifically to respective and identical initial rectifier network portions 30 thereof. Each network portion 30 comprises a diode 31 for producing a halfwave rectified signal, which is then filtered by the associated R-C components, the output of each network 30 thereby being a DC voltage corresponding to the AC voltage across the corresponding motor input terminals ($V_{ab}$, $V_{bc}$, or $V_{ca}$).

The outputs from the rectifier networks 30 are respectively coupled (by way of smoothing networks comprising resistor 32 and capacitor 33) to the input of respective and identical comparator networks 40, each of said networks 40 being effective to compare the DC voltage at its respective input with a fixed reference voltage (from network 90) and to generate an appropriate "error" signal (positive or negative) at the output of each network 40 in the event of, and proportional to the nature and extent of, deviations from this reference voltage.

Figure 2:
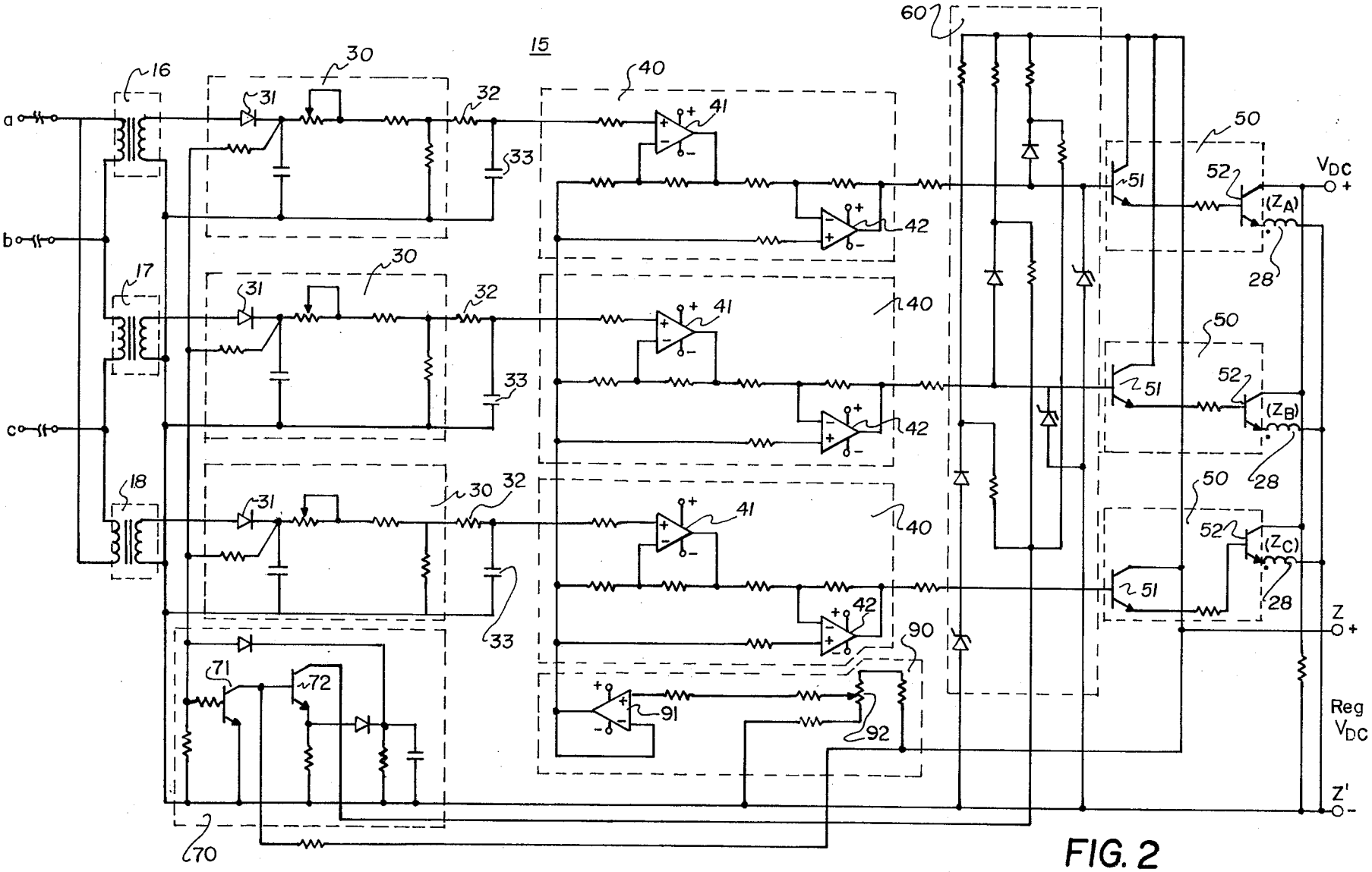
FIG. 2 is a detailed schematic of a preferred form of the feedback control portion of the overall regulator-compensator.

Each comparator network 40 comprises appropriately biased amplifiers 41 and 42 which, along with the associated resistive components, are interconnected in the manner depicted in FIG. 2, the non-inverting amplifier 41 providing a high impedance buffer to the differential inverting amplifier 42. Each network 40 operates so that positive voltage deviations (above the reference voltage) at the input to each network portion 40 will produce a negative error signal at the output of amplifier 42 (and thus at the output of network 40); and negative voltage deviations (below the reference voltage) at the input to network 40 will produce positive error signal at the output of network 40. Of course, when the DC voltage level at the input to network 40 is equal to the reference voltage, no error signal will be generated at the output of comparator 40.

Coupled to the outputs of the comparator networks 40 are respective identical control winding drive networks 50 for adjusting the extent of current supplied to the saturable core reactor DC control windings in accordance with the polarity and magnitude of the error signals appearing at the output of each comparator circuit 40. It is to be understood that each of the three DC control windings 28 depicted in FIG. 2 corresponds to the control winding of a saturable core reactor respectively utilized as the variable impedance elements $Z_A$, $Z_B$, and $Z_C$.

Each network 50 includes an initial driver transistor 51 having its emitter connected to the base of a transistor 52. While transistor 52 is depicted in the drawings as a single unit, in actuality it may be desirable to utilize a pair of cascaded transistors therefor interconnected in a conventional Darlington amplifier arrangement. When a positive error signal appears at the input to network 50 (at base of transistor 51), this will result in increased current being supplied to control winding 28 which thereby drives the particular saturable core reactor further into saturation (thus reducing the overall impedance), the extent of saturation of course being dependent upon the magnitude of the error signal. Similarly, a negative error signal at the input to network 50 decreases the current supplied to control winding 28, reducing the saturation and increasing the overall impedance of the saturable core reactor element ($Z_A$, $Z_B$, or $Z_C$).

A bias network 60 is connected as illustrated in FIG. 2 and is effective to bias the collector of each drive transistor 51 to a level which furnishes sufficient DC current to the coils 28 to maintain the saturable core reactors 20 at saturation. In this regard, a fail-safe network 70 comprising cascaded transistors 71 and 72 (and associated components) is coupled between the output of the rectifier diodes 31 and the input to the bias network 60 to assure that saturable core reactors are maintained at saturation under initial start-up conditions and to disable the biasing current to the DC coils 28 during full operation of the control network 15.

As previously briefly mentioned, the reference voltage to the comparator networks 40 is provided by a reference voltage generator network 90. Accordingly, the network 90 includes a suitable biased operational amplifier 91 having its non-inverting (+) input connected to field adjustable resistor or potentiometer 92 for providing a means for selectively varying the voltage output from the amplifier 91 (and thus the value of the reference voltage to each comparator 40). The amplifier 91 is driven from a regulated DC voltage source provided across the terminals Z and Z'.

It is therefore apparent that the control network 15 provides feedback control for regulating the voltage drop between the supply and motor input terminals for each of the three phases with an identical network portion 30, 40, and 50 being respectively provided for each phase for respectively varying the impedance of elements $Z_A$, $Z_B$, and $Z_C$. Accordingly, the overall regulator-compensator network 10 is initially calibrated or "set" by adjusting (by potentiometer 92) the fixed reference voltage supplied by the voltage generator network 90 to the comparator networks 40 so that (1) the voltages $V_{ab}$, $V_{bc}$, and $V_{ca}$ are at the desired balanced values and (2) the effective impedance of each of the saturable core reactors providing the elements $Z_A$, $Z_B$, and $Z_C$ are generally in a mid-range of anticipated impedance variations. The so set network 10 thus provides initial balanced voltage conditions across the motor terminals a, b, and c and is ready to provide effective compensation in the event of subsequently occurring unbalanced conditions.

Assume now, during the operation of the motor 1, that the supply voltage $E_{AB}$ alone drops below its normal magnitude, thus correspondingly dropping the input voltage $V_{ab}$ to the motor. This drop in voltage will then be sensed by the voltage sensing transformer 16, thereby generating a correspondingly reduced DC voltage at the output of the associated rectifier network 30 which, due to the inverting and comparator function of the network 40, will generate a positive error signal to the associated control winding drive network 50, thereby increasing the current furnished to the control winding 28 of the saturable core reactor element $Z_A$. As previously discussed, this will then reduce the impedance presented by element $Z_A$, thereby reducing the voltage drop in supply line 11, and effectively increasing the voltage $V_{ab}$ back to its original balanced magnitude. Similarly, magnitude drops in either of the other phase supply voltages $E_{BC}$ or $E_{CA}$ would similarly result in an adjustment to the voltage drops in supply line 12 or 13, as the case may be, to also reestablish the balanced conditions. It is also believed apparent that increases in either one of the supply voltage $E_{AB}$, $E_{BC}$, or $E_{CA}$ would similarly be compensated for by increased voltage drops in the supply lines 11–13 (by increases in the impedance presented by the elements $Z_A$, $Z_B$, or $Z_C$) for also effectively reestablishing the balanced conditions to the motor.

It should also be appreciated that phase angle imbalances at the supply terminals A, B, and C are also compensated for by the network 10 of the present invention. Any shift in such phase angles will, as a consequence, produce corresponding changes in the phase-to-phase voltage across the terminals a, b, and c which will therefore be sensed by the voltage sensing transformers 16–18. Such a shift in phase angle will therefore be compensated for in the same manner as just described with respect to magnitude imbalances.

It should also be appreciated that the network 10 effectively provides true voltage regulation since any voltage fluctuations across the terminals a, b, and c below or above the desired rated value would generate identical error signals (as to both polarity and magnitude) at the output of each of the comparator networks 40, thus simultaneously increasing or decreasing, as the case may be, the impedance of the elements $Z_A$, $Z_B$, and $Z_C$ to re-establish the desired constant voltages to the load.

In addition to the previously described compensation and regulation advantages of the network 10, the use of the saturable core reactor devices as the variable impedance elements $Z_A$, $Z_B$, and $Z_C$ offers an additional advantage in the sense that it provides transient voltage protection. Specifically, since the impedance of these elements is almost entire reactive, rather than resistive, and since surge voltage transients are often of extremely high frequencies, the network 10 provides inductive voltage drops proportional to the transient voltage frequencies, thus substantially reducing (or eliminating) the transient voltage magnitudes to safer levels.

It is to be appreciated that various modifications and additions may be made to the network 10 increasing its usefulness. For example, the control network 15 may include various protective relay networks for interrupting the power to the motor in the event of a loss of phase or extremely low voltage conditions or in the event of the loss of the regulated voltage supply to the reference voltage generator network 90.

Various other modifications to the enclosed embodiment, as well as alternate embodiments, of the present invention may become apparent to one skilled in the art without departing from the spirit and scope of the invention as defined by the appended claims.

What is claimed is:

1. In a system for supplying power to a load from a polyphase source, the improvement comprising a regulator-compensator control interconnected between the source input terminals and the load input terminals, said regulator-compensator control comprising:

means for independently sensing the respective voltages across the load input terminals;

a feedback control network coupled to said voltage sensing means for generating a separate and independent control signal in response to each sensed terminal voltage; and a control signal responsive, variable impedance element connected in series circuit relation between said source input terminals and said load input terminals, each variable impedance element being connected to said feedback control network to receive the corresponding independent control signal, with the impedance of each variable impedance element changing in response to a change in the associated control signal to selectively alter the voltage drops in each of the supply lines.

2. The improvement as defined by claim 1 wherein each of said variable impedance elements is a saturable core reactor.

3. The improvement as defined by claim 2 wherein said feedback control network is effective to alter the magnitude of current supplied to the DC control winding of each of said saturable core reactors.

4. The improvement as defined by claim 3 wherein said feedback control network comprises, for each phase of said polyphase system:

a. a rectifier network having its input coupled to the output of one of said sensing means;

b. a comparator network having its input coupled to the output of said rectifier network for generating an error signal in response to the difference between the signal from said rectifier network and a fixed reference signal; and c. a control winding drive network having its input connected to the output of said comparator network and its output connected to said DC control winding for supplying current to said DC control winding in response to the magnitude and polarity of the signal from the signal from the output of said comparator network.

5. The improvement as defined by claim 4 wherein said control network further includes means for biasing said control winding drive network to an extent whereby the current furnished to said DC control winding maintains its associated saturable core reactor at saturation.

* * * * *